United States Patent [19]

Bray

[11] 4,296,556

[45] Oct. 27, 1981

[54] ROD COOLING BOX AIR WIPE NOZZLE

[75] Inventor: Lynn W. Bray, Antioch, Calif.

[73] Assignee: United States Steel Corporation, Pittsburgh, Pa.

[21] Appl. No.: 139,074

[22] Filed: Apr. 10, 1980

[51] Int. Cl.[3] ..... F26B 13/28

[52] U.S. Cl. ..... 34/107; 34/148; 15/306 R; 72/39; 266/259

[58] Field of Search ..... 34/20, 155, 160, 156, 34/105, 21, 107, 148; 15/306 A, 306 R; 72/38, 39; 266/259

[56] References Cited

U.S. PATENT DOCUMENTS

| | | | |
|---|---|---|---|
| 1,575,526 | 3/1926 | Bocher | 15/306 A |
| 3,044,098 | 7/1962 | Stalson | 15/306 A |
| 3,270,364 | 9/1966 | Steele | 15/306 A |
| 3,595,045 | 7/1971 | Fuqua | 72/39 |
| 4,000,625 | 1/1977 | Beerens et al. | 62/63 |

*Primary Examiner*—Larry I. Schwartz
*Attorney, Agent, or Firm*—John F. Carney

[57] ABSTRACT

An air wipe nozzle for removing water from a rod as it emerges from a water cooling tube in a rod mill is provided. The air nozzle includes a tubular head through which the rod passes, the header having a plurality of passages terminating in openings spaced around the periphery of the tube interior and directed at an acute angle with respect to the tube axis. The passages are configured to receive compressed air and direct it through the openings against the movement of the rod through the housing toward the entry end of the housing. A second group of openings spaced downstream in the header from the other openings directs additional air against the rod to completely remove water from the rod surface. Direction of the air toward the upstream direction of travel of the rod creates a vacuum at the exit end of the header and draws air therein to prevent passage of water along the header itself.

2 Claims, 2 Drawing Figures

ROD COOLING BOX AIR WIPE NOZZLE

BACKGROUND OF THE INVENTION

Previous apparatus have been provided for removing water from a rod as it emerges from a water cooling tube in a rod mill. For the most part these water removing devices have employed water under great pressure to remove the water from the rod. These water-strippers have a tendency to plug up due to impurities in the water and cause the carryover of water on the rod thereby making the rod unsuitable for marketing purposes. These water-strippers have also required the use of a constant pump-packing maintenance and have an inherent difficulty in being properly adjusted for the proper flow of water under pressure.

Air strippers have been previously employed to remove water from the rod during the cooling process but have been inefficient in their configuration to provide for the water stripping function required. Once example of such a stripper is shown in U.S. Pat. No. 4,000,625 issued to Beerens, et al on Jan. 4, 1977. Therefore, there is a need for an improved water stripping nozzle to be employed in a rod cooling apparatus which is easy to maintain and which is not susceptible to the disadvantages inherent in water strippers which employ water itself to strip water from the rod as well as ineffective and inefficient air stripping nozzles.

SUMMARY OF THE INVENTION

The present invention is addressed to an air wipe nozzle for a rod cooling box which is employed to remove water from a rod as the rod emerges from a water cooling tube in a rod mill. The air wipe nozzle includes a tubular header through which the rod passes. The header includes a plurality of passages terminating in openings spaced about the periphery of the tube interior and directed at an acute angle with respect to the tube axis against the direction of material flow therethrough. The passages receive a supply of compressed air through an air compression housing and direct the same through the openings against the rod and toward the entry end of the housing. A second group of openings spaced downstream in the header from the other openings direct additional air against the rod to completely remove water from the rod surface. The configuration of the nozzle as well as the direction of air therethrough toward the upstream direction of travel of the rod creates a venturi vacuum effect at the exit end of the header thereby drawing air therethrough to prevent passage of water along the header itself.

Accordingly, it is a general object and feature of the present invention to provide a novel air wipe nozzle for use in a rod cooling box.

Another object and feature of the present invention is to provide an air wipe nozzle having a plurality of passages therethrough which direct the compressed air in a direction against the direction of travel of the rod through the housing.

Another object and feature of the present invention is to provide an air wipe nozzle having a plurality of passages therethrough which direct the compressed air in a direction against the direction of travel of the rod through the housing, the nozzle including additional openings spaced downstream for providing a venturi vacuum effect to the exit end of the nozzle for completely removing water from the rod surface and the nozzle header.

Other objects and features of the present invention will, in part, be obvious and will, in part, become apparent as the following description proceeds. The features of novelty which characterize the invention will be pointed out with particularity in the claims, annexed to and forming part of the specification.

BRIEF DESCRIPTION OF THE DRAWINGS

The novel features which are considered characteristic of the invention are set forth with particularity in the appended claims. The invention itself, however, both as to its structure as well as its operation, together with the additional objects and advantages thereof, will best be understood from the following description of the preferred embodiment of the present invention when read in conjunction with the accompanying drawings wherein:

DETAILED DESCRIPTION OF THE DRAWINGS

Figure 1:
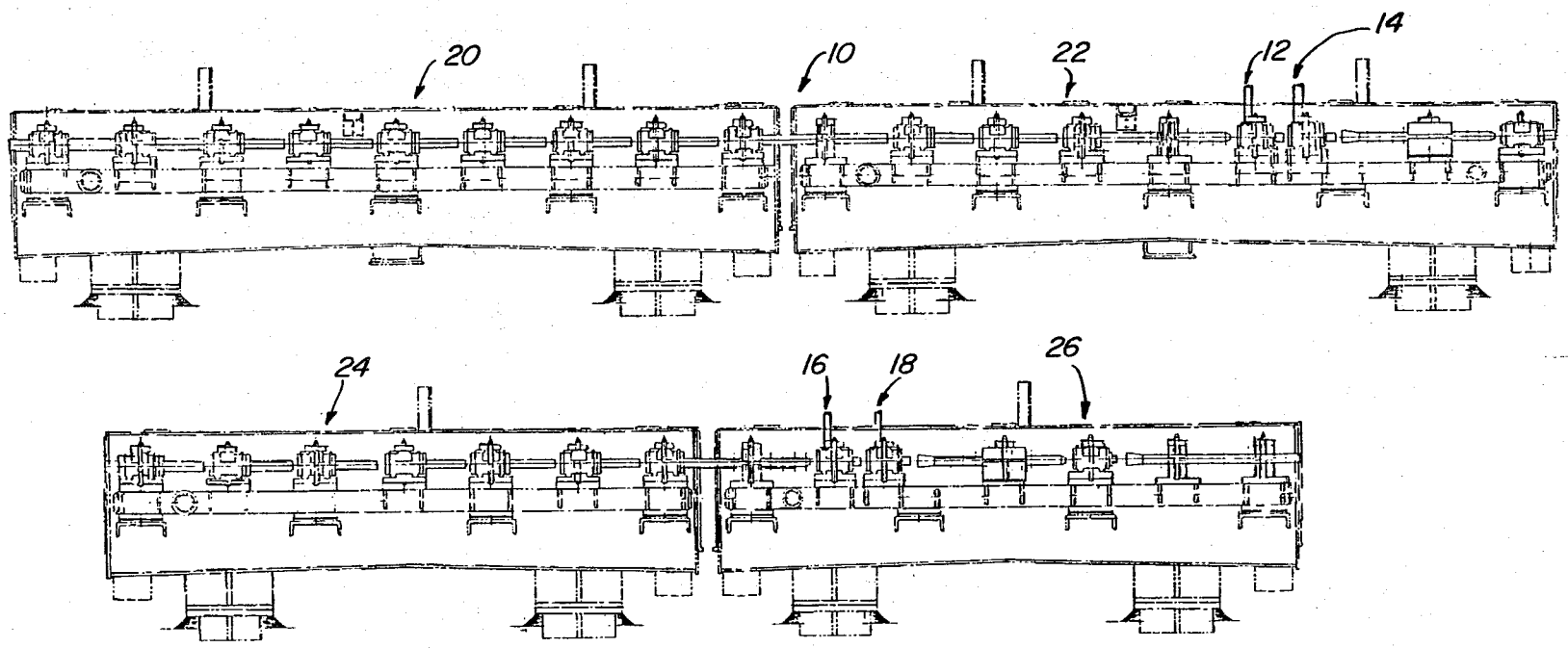
FIG. 1 is a side elevational view of a cooling box arrangement for use in a rod mill which incorporates the air wipe nozzle of the present invention.

Looking to FIG. 1, there is shown a rod cooling and water stripping arrangement 10 employed within a rod mill. The rod cooling and water stripping arrangement 10 is employed for selectively cooling the rod as it passes therethrough at relatively high rates (10,000 ft/min.). The water strippers indicated generally at 12, 14, 16 and 18 are intermittently located along the cooling path at selective locations to ensure the proper cooling of the rod from its formation temperature to a lower temperature. The rod cooling arrangement 10 employs a series of cooling boxes (in this case four in number) indicated at 20, 22, 24 and 26. Each of the cooling boxes incorporates a plurality of cooling tubes which utilize water to decrease the temperature of the rod passing therethrough. However, prior practice has indicated that water buildup along the length or portions of the length of the rod inhibit the proper cooling rate of the rod, and therefore, must be stripped from the rod before additional water cooling may be applied. It is for this reason that water stripping nozzles are placed in one or more of the cooling boxes. In the preferred embodiment of the invention described herein, the water strippers are placed in pairs in cooling boxes 22 and 26, but may be placed in any order or arrangement which is deemed desirable by the rod mill operator in order to effect the proper cooling of the rod.

Figure 2:
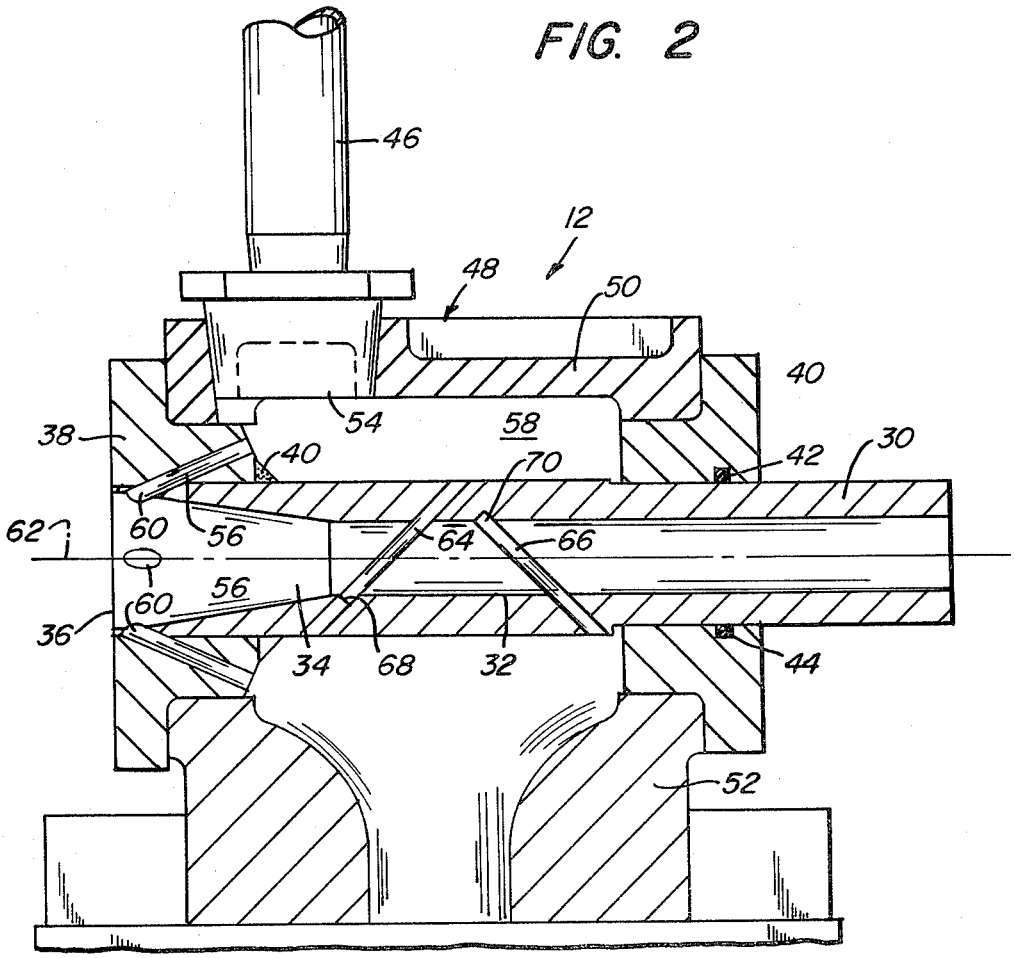
FIG. 2 is a side elevational view in section of the air wipe nozzle of the present invention shown in combination with a compressed air housing with which the nozzle is employed.

The specific detailed arrangement of the air wipe nozzle of the present invention may best be seen by reference to FIG. 2 which is a side cross-sectional view of one of the air wipe nozzles indicated in FIG. 1. Looking to FIG. 2, there is shown an air wipe nozzle arrangement which is indicated generally at 12. The remaining air wipe nozzles or water strippers shown in FIG. 1 are of similar construction and configuration. The air wipe nozzle 12 is composed of a tubular member 30 through which the rod (not shown) is passed. The tube 30 has a generally linear wall construction portion 32 and a coned or funnelled portion 34 which acts as a guide to the rest of the tube for the rod entering therein.

Mounted to the front portion 36 of the tube 30 or formed integrally therewith, is a donut-shaped front header element 38 which totally encompasses and surrounds the front portion 36 of the tube. In the embodiment shown in FIG. 2, the front header element 38 is welded to the tube as at 40. It should be apparent, however, that the front header element 38 may be integrally formed with the tube 30. Formed integrally with the tube also is a rear header element 40 which may be directly attached to the tube portion, formed integrally with the tube or, as in the preferred embodiment herein discussed, may merely be slip-fitted over the tube as indicated therein. When a slip-fit configuration is effected, a sealing element 42 in the form of a sealing ring is placed within a cut-out 44 formed in the rear header element 40 for sealing the rear header element 40 with respect to the tube.

Compressed air is provided to the tube via a supply pipe 46 which terminates in a compressed air housing 48 of any conventional or desirable design. The compressed air housing 48 is composed of a top portion 50 and a lower portion 52 which are bolted or attached together by any conventional means. The compressed air from the pipe 46 enters into the compressed air housing via an orifice 54 located on the top of the compressed air housing 48. Due to the configuration of the housing, the compressed air may enter the orifices provided in the tube from both above as well as below without any pressure drop.

As indicated previously, the air wipe nozzle 12 includes a tubular header 30 through which the rod passes. The header is configured having a plurality of passages indicated at 56 which extend between the air reservoir 58 formed within the compressed air housing 48 and extending in a forward direction at an acute angle with respect to the axis of the header and terminating in openings as at 60 spaced around the inner periphery of the tube at the front header element 38. These passages receive a supply of compressed air from the reservoir 58 and directed through the openings 60 onto the rod at an acute angle. The compressed air flowing through these plurality of openings (in the preferred embodiment four equally spaced openings) is sufficient to strip the water remaining on the rod as it exits from the cooling headers of the cooling boxes. The acute angular relationship of the passage orientation with respect to the axis 62 of the tube provides for an efficient air stripping of the water from the rod. Spaced downstream in the header, and located in the linear inner diameter portion of the tube are a second group of openings which direct air from the air reservoir 58 into the central portion of the tube to completely remove any remaining water from the rod surface. In the preferred embodiment of the present invention these second openings are configured as cuts or slots 64 and 66 which are made through a substantial portion of the tube as shown in FIG. 2. The cuts 64 and 66 start from the top of the tube and the bottom of the tube, respectively, and terminate as at 68 and 70, respectively, proximate the inner diameter of the tube. As shown in FIG. 2, the angular orientation of the cuts 64 and 66 is made approximately 45° with respect to the axis 62 of the tube 30. Cuts are provided instead of holes in order to increase the volume of air entering from the air reservoir 58 into the tube for water stripping purposes. The angular orientation of the slots or cuts 64 and 66 with respect to one another provide a flow of air toward the front end of the air wipe nozzle 12 for ensuring the complete removal of water from the rod surface and, in addition, creates a venturi effect within the tube 30 thereby creating an area of air turbulence at the head end of the tube and a vacuum at the exit end of the header. The provision for the creation of the vacuum at the exit end of the tube draws air therein at the exit end and prevents passage of water along the header itself which may have dropped off the rod onto the inner diameter of the tube 30. The creation of a venturi effect within the tube 30 due to the slots 64 and 66, as well as the passages 56 provides for water stripping air turbulence at the front of the header and the creation of the advantageous vacuum at the rear or exit end of the tube 30 thereby ensuring the complete removal of water from the rod surface prior to its continued cooling in the remainder of the cooling box or boxes.

In conclusion, it can be seen that there is provided an air wipe nozzle or water stripper which is of simplified design and construction. Additionally, the particular configuration of the air wipe nozzle and in particular the angular orientation of the passages as well as the slots, initiates the removal of water at the head end of the air strip nozzle, creates an air turbulence at the front end of the air wipe nozzle, and creates a vacuum at the exit end of the nozzle, all of which ensure the removal of water from the rod which if permitted to exit would deleteriously effect the product quality. The efficient removal of the water through the use of compressed air which is available within the rod mill itself provides for a more simple and efficient removal of the water at intermittent positions within the rod cooling boxes themselves.

While certain changes may be made in the above noted apparatus without departing from the scope of the invention herein involved, it is intended that all matter contained in the above description or shown in the accompanying drawings, shall be interpreted as illustrative and not in a limited sense.

I claim:

1. An air wipe nozzle apparatus for removing water from a rod in a rod mill, said apparatus including:

(a) compressed air housing means, including means defining an air inlet connected to a source of compressed air and an air reservoir for receiving compressed air from said air inlet;

(b) air nozzle means extending through said compressed air housing and being configured as a tube having an entrance end and an exit end permitting the passage of rods axially therethrough, said air nozzle means including:

(i) first air passage means comprising a plurality of holes extending from said air reservoir and communicating at an acute angle with said tube proximate the entrance end to direct compressed air from said reservoir against a rod entering said tube, and (ii) second air passage means positioned downstream from said first air passage means and comprising a pair of slits extending through a portion of said tube from said air reservoir oriented at about forty-five degrees with respect to the axis of said tube and the direction of rod movement therethrough and being oriented substantially normal to each other for producing a venturi effect within said tube whereby air is drawn in from the exit end and moved toward the entrance end for wiping a contained tube clean of water and to create water stripping air turbulence at said entrance end and a vacuum at said exit end for ensuring the complete removal of water from said rod.

2. The air wipe nozzle apparatus according to claim 1 wherein one of the slits is made through the top portion of the tube and terminates proximate the inner diameter at the lower end of the tube and the other slit is made from the bottom of the tube and extends through the tube terminating proximate the inner diameter at the top of the tube, said slits providing for a maximized passage of air from said air reservoir into said tube for increasing the air-wiping operation of the tube and creating a venturi effect in the tube which directs air from the exit end of the tube toward the entrance end of the tube.

* * * * *